US009435543B2

(12) United States Patent
Spencer

(10) Patent No.: US 9,435,543 B2
(45) Date of Patent: Sep. 6, 2016

(54) FIREPLACE DISPOSABLE TRAY

(71) Applicant: Kim T. Spencer, Decatur, GA (US)

(72) Inventor: Kim T. Spencer, Decatur, GA (US)

(73) Assignee: Kim T. Spencer, Decatur, GA (US)

( * ) Notice: Subject to any disclaimer, the term of this patent is extended or adjusted under 35 U.S.C. 154(b) by 536 days.

(21) Appl. No.: 13/741,120

(22) Filed: Jan. 14, 2013

(65) Prior Publication Data

US 2014/0196714 A1 Jul. 17, 2014

(51) Int. Cl.
*F24B 1/191* (2006.01)
*F23H 11/24* (2006.01)

(52) U.S. Cl.
CPC ..... *F24B 1/1915* (2013.01); *F23H 11/24* (2013.01)

(58) Field of Classification Search
CPC ..... F24B 1/1915; F24B 1/191; F23H 11/24; F23H 11/26; F23H 1/191
USPC ..... 126/543
See application file for complete search history.

(56) References Cited

U.S. PATENT DOCUMENTS 420,559 A * 2/1890 Lincoln ..... 126/542
1,308,245 A * 7/1919 Klucina ..... 126/244
1,318,548 A * 10/1919 Gehrmann ..... F24B 13/008 126/243
2,006,811 A * 7/1935 Mersbach ..... A24F 19/0028 131/240.1
2,377,665 A * 6/1945 Best ..... F24B 1/1915 126/243
2,836,340 A * 5/1958 Crowley ..... A24F 19/0028 126/9 A
3,385,282 A * 5/1968 Lloyd ..... A47J 36/30 126/25 R
4,074,679 A * 2/1978 Jensen ..... 126/507
4,526,158 A * 7/1985 Lee ..... 126/9 R
5,010,874 A * 4/1991 Toth ..... 126/543
5,513,625 A * 5/1996 Landman ..... 126/152 R
D416,620 S * 11/1999 Plociak ..... D23/420
6,006,744 A * 12/1999 Taylor ..... F24B 1/1915 126/243
6,968,839 B2 * 11/2005 Lee ..... F24B 1/193 126/543
2006/0054161 A1 * 3/2006 Brown ..... F24B 13/006 126/555
2014/0137876 A1 * 5/2014 White ..... A24F 19/0064 131/256

* cited by examiner

*Primary Examiner* — Christopher Harmon

(57) ABSTRACT

Fireplace Disposable Tray is a non-flammable aluminum tray use for the sole purpose to capturing burning ash, coal, from wood, and/or fireplace burning log inside of a fireplace. The Fireplace Disposable Tray is placed inside of a fireplace on the floor, which has handles to lift tray from the fireplace to dispose of burnt ash without messing spills and easy disposal. This invention can be in different dimensions of fireplace in home setting. The invention sole purpose is to capture ash, burnt wood or burnt fireplace burning log. It will assist in cleaning ash, burnt wood and/or burnt fireplace log and disposing of it easier in a much clean friendly way. Such a Fireplace Disposable Tray will assist in burnt ash, from wood or fireplace log from spilling on fireplace outer flooring and making disposing of it much more efficient.

1 Claim, 1 Drawing Sheet

FIREPLACE DISPOSABLE TRAY

BACKGROUND OF THE INVENTION

A fireplace tray is used to capture ash from burn wood and/or ash from a burning fireplace log to eliminate messy burnt ash spills and easy disposal.

SUMMARY OF INVENTION

The Fireplace Disposable Tray is a non-flammable aluminum tray use for the sole purpose to capturing burning ash, coal, from wood, and/or fireplace burning log inside of a fireplace. The Fireplace Disposal Tray is tray placed in a fireplace on the fireplace floor. Dimensions front lip can range from 4 ft to 5 ft wide in front, 1 ft to 2 ft wide in back, 1 ft to 1½ ft. side widths. Dimensions rear folding edges can range from 16 inches (1¼ ft.) to 24 inches (2 ft.) wide. Invention left and right folding edges dimensions can range from 18 inches (1½ ft.) to 24 inches (2 ft.) wide.

DETAILED DESCRIPTION

Figure 1:
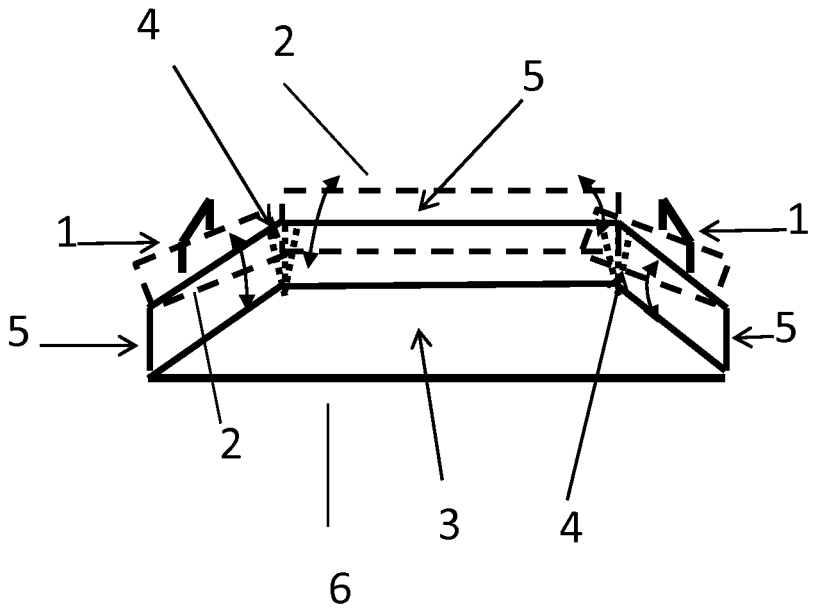
FIG. 1 illustration is a view of the Fireplace Disposable Tray with the folded edges being unfolded and without the perforated slit for gas pipe.
Figure 2:
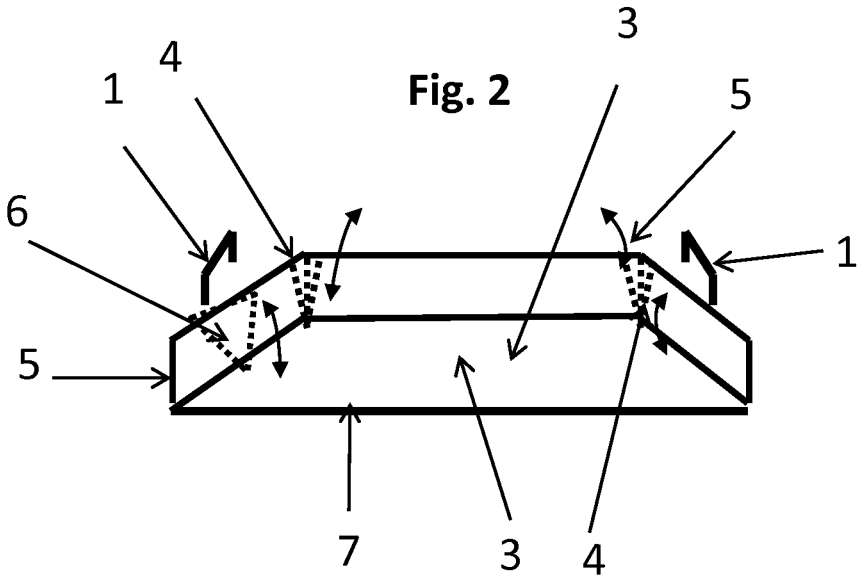
FIG. 2 illustration is a view of the Fireplace Disposable Tray with a perforated slit for gas pipe in fireplace as some fireplaces do not have gas pipe, but only a fireplace grate.

Fireplace Disposable Tray is used for the sole purpose of capturing burning ash, coal, from wood, and/or fireplace burning log to be used inside of a fireplace. The tray is an aluminum flat trapezoidal shape object. When placing the tray inside of the fireplace, right and left side and rear folded edges 5 are laid flat on the tray bottom 3. First remove fireplace grate out of the fireplace. Place the Fireplace Disposable Tray inside the fireplace by laying it flat on fireplace floor. Smooth it out with your hands on the fireplace floor and to secure the best fit. The best fit is depended upon the size of the fireplace in a setting.

Place the required size Fireplace Disposable Tray on the floor of the fireplace. The flat folded edges 5 are lifted upward with the accordion side rear pleated accordion right and left side rear corners 4 to give the tray flexibility. The folded edges are to hold the ash and/or firewood coal from spilling on the floor of the fireplace. The front lip edge 7 has an aluminum wire gauge, approximately 6.5 m to hold the weight of the tray. The fireplace disposable tray material is a heavy duty non-flammable aluminum, which keeps the floor of the fireplace clean and free of ash stains.

The Fireplace Disposable Tray (FDT) can hold up one (1) to four (4) pile of ash from the fireplace burnings. Once the tray is mid to half way full, you lift the fireplace disposable tray from the fireplace by the wire handles 1 attached to side folding edges. At this time the ash is cool, not hot or warm, but cold ash burnt wood. Not at any time is the tray to be lifted out of fireplace with warm, hot burning wood/coal. Lift the tray and slide it out towards you about quarter of the way from the fireplace rear. Proceed to fold tray gathering all ends to the center of the fireplace to eliminate spills from the tray while in the fireplace. It is suggested to fold the tray inside of the fireplace holding the ash/burnt wood coal. Then proceed with taking the gathered folded fireplace disposable tray out of the fireplace to the trashcan nearby. This invention (Fireplace Disposable Tray) is to capture ash, burnt wood, or burnt fireplace burning log. It will assist in cleaning ash, burnt wood and/or burnt fireplace log and disposing of it easier in a much spotless, clean way. Such a disposable tray will eliminate burnt ash, from wood or fireplace log from spilling on fireplace outer flooring and making disposing of it much more efficient. The invention has a perforated slit 6 for receiving a gas pipe in a fireplace; approximately 1.5 to 2 inches wide.

I claim:

1. A disposable aluminum fireplace tray comprising a trapezoidal base; a rear folding edge; two side folding slide edges each connected to said rear folding edge by a pleated portion; wire portions configured inside folds and along a front lip for durability; two flexible wire handle portions each connected to a respective side folding edge for tray handling and folding of said folding edges from a flat folded configuration to an erected configuration.

* * * * *